United States Patent [19]

Kuhl

[11] Patent Number: 4,604,498

[45] Date of Patent: Aug. 5, 1986

[54] SEAL BETWEEN A METALLIC MOUNTING AND A GLASS FIBER ROD IN HIGH VOLTAGE COMPOUND INSULATORS AND METHOD OF FORMING SAME

[75] Inventor: Martin Kuhl, Selb/Bayern, Fed. Rep. of Germany

[73] Assignee: Hoechst CeramTec AG, Selb, Fed. Rep. of Germany

[21] Appl. No.: 573,622

[22] Filed: Jan. 25, 1984

[30] Foreign Application Priority Data

Jan. 28, 1983 [DE] Fed. Rep. of Germany ..... 3302788

[51] Int. Cl.[4] ..... H01B 17/02; H01B 17/46

[52] U.S. Cl. ..... 174/140 S; 29/631; 156/293; 174/179

[58] Field of Search ..... 174/140 S, 176, 177, 174/178, 179, 186, 209; 29/631; 156/293; 403/268

[56] References Cited

U.S. PATENT DOCUMENTS

| | | | |
|---|---|---|---|
| 3,898,372 | 8/1975 | Kalb | 174/179 |
| 4,212,696 | 7/1980 | Lusk et al. | 174/179 |
| 4,246,696 | 1/1981 | Bauer et al. | 174/179 X |
| 4,281,943 | 8/1981 | Viennot | 403/268 X |
| 4,426,240 | 1/1984 | Louis et al. | 156/99 |
| 4,427,843 | 1/1984 | Ishihara et al. | 174/179 X |

FOREIGN PATENT DOCUMENTS

| | | | |
|---|---|---|---|
| 365846 | 2/1982 | Austria . | |
| 2824587 | 12/1979 | Fed. Rep. of Germany | 174/179 |
| 2855211 | 7/1980 | Fed. Rep. of Germany | 174/179 |
| 1126411 | 9/1968 | United Kingdom | 174/179 |

OTHER PUBLICATIONS

Harper, Charles A., "Giessharze in der Elektronischen Teschnik" (Casting Resins in Electronic Technology), pp. 99, 114–129, Munich (1963).

*Primary Examiner*—Laramie E. Askin

*Attorney, Agent, or Firm*—Schwartz, Jeffery, Schwaab, Mack, Blumenthal & Evans

[57] ABSTRACT

An effective seal between the suspension mounting and the glass fiber rod of a compound high voltage insulator is obtained by filling the gap with a mixture of cross-linkable monomers or polymers formed from two or more reactive components, the mixture having a viscosity prior to cross-linking of less than 100,000 mPa.s and a penetration value between 1–500 mm/10 after cross linking. Particularly suitable are polymers based on polyorganodimethylsiloxanes.

9 Claims, 2 Drawing Figures

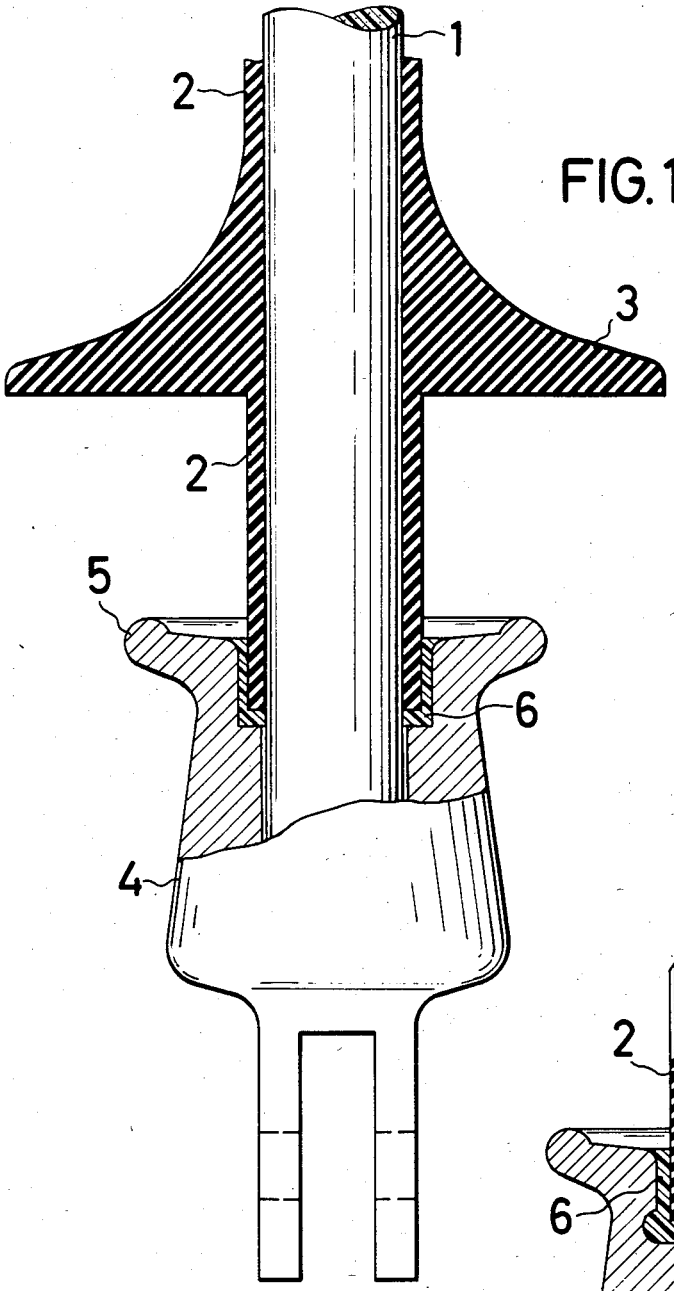
FIG. 1
FIG. 2
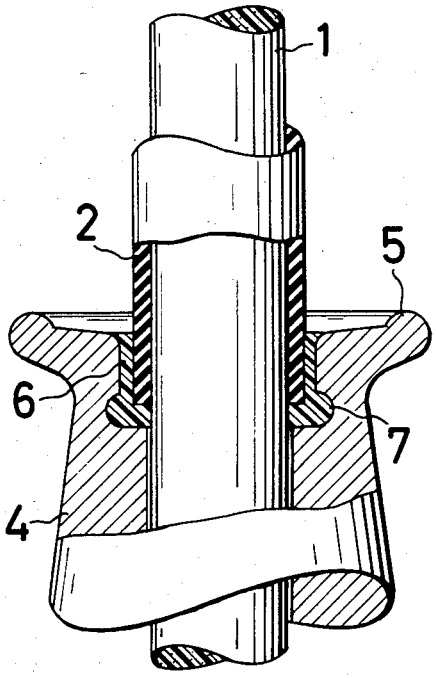

SEAL BETWEEN A METALLIC MOUNTING AND A GLASS FIBER ROD IN HIGH VOLTAGE COMPOUND INSULATORS AND METHOD OF FORMING SAME

BACKGROUND OF THE INVENTION

The invention pertains to a seal in a high voltage compound insulator which is comprised of a glass fiber reinforced synthetic plastic rod with a surrounding coating and suspension mounting located at the ends of the rod, wherein a part of each suspension mounting surrounds the coating of the rod and each suspension mounting is provided with a circumferential bead pointing outwardly in the radial direction.

Difficulties have arisen in connection with the aforementioned type of insulators, which insulators are described, for example, in U.S. Pat. No. 4,246,696. Specifically, chemicals dissolved by humidity have penetrated the inside of the insulator rod, thereby initiating electrical and mechanical destruction therein. Penetration occurs preferentially at the interface of two different materials, such as, for example, at the boundary surface between the glass fiber reinforced synthetic plastic rod and the metal suspension mounting. Attempts have therefore been made in the art to seal these critical locations by fitting the surrounding coating of the glass fiber reinforced rod over the suspension mounting, thereby using it as a seal. Such a measure is disclosed in U.S. Pat. No. 3,898,372. However, actual practice has shown that seals of this type are vulnerable to breakdown, because the electric potential migrates over the atmospherically soiled insulator surface to the other mounting.

A second approach has been described in U.S. Pat. No. 4,281,943, wherein the glass fiber reinforced rod is projected with its surrounding coating into a metal mounting equipped with a circumferential bead at the end of the mounting which faces the insulator. It is the function of this bead to render unstable partial arcs on the insulator, thereby preventing heat damage to the insulator rod. But there remains a gap between the inner surface of the mounting and the coating, into which corrosive atmospheric components may penetrate.

Sealing measures of the type proposed in the preceding paragraph have the disadvantage that they become ineffective in time, when significant temperature fluctuations outdoors of more than 100° C. cause the synthetic plastic materials to give way under the applied pressure. Thus, they do not assume quite their original shape when the pressure is relieved, if an attempt is made, as set forth in U.S. Pat. No. 4,427,843, to press the part of the mounting surrounding the coating radially onto the coating in order to obtain airtightness. If it cannot be ensured that this contact pressure is not reduced, after a certain number of temperature cycles, gaps will appear, especially between the suspension mounting and the insulator rod, even if the gap is filled with known, hardenable polymers such as epoxy resins or silicone rubber.

A further measure to prevent the formation of gaps is disclosed in Austrian Pat. No. 365 846, whereby the space between the suspension mounting and the coating is filled with a synthetic grease such as silicone grease. These synthetic greases, in particular silicone grease, are composed of organic chain compounds. Their thixotropy is adjusted by means of mineral or organic fillers, such as, for example, very fine grained silica in silicone grease. However, the low viscosity constituents of these synthetic greases tend over time to diffuse into the adjacent material, e.g., the glass fiber reinforced rod of the insulator discussed above. A filler skeleton with the high viscosity organic components remains. Furthermore, experiments at temperatures around 100° C. and for extended exposure times have shown that these synthetic greases form fine internal cracks. This is readily demonstrated by exposing the insulator to various temperature cycles and then immersing it in a water bath colored with a red dye, followed by an inspection inside for traces of the dye. It is also difficult to place such greases into small gaps so that all cavities are filled exactly, since the greases must be highly viscous to keep them from running out of the gap at elevated temperatures and over extended periods of time.

SUMMARY OF THE INVENTION

It is therefore an object of the present invention to provide an improved compound insulator.

It is also an object of the invention to provide simpler and more secure means for permanently sealing the gap between the inner wall of the suspension mounting and the glass fiber reinforced rod against aqueous media, while maintaining resistance of the seal to elevated temperatures.

It is a further object of the present invention to provide a process for establishing such a temperature-resistant seal whereby even small gaps are filled and the resultant seal does not dry out over time.

The foregoing objects are attained by sealing the gap between the suspension mounting and the rod or coating, respectively, with cross-linking monomers or polymers, comprising two or more components, which are no longer flowable or castable but still sticky after cross-linking. More specifically, according to one embodiment of the present invention, a seal is provided comprising the reaction product of two or more reactive cross-linkable components, such that a mixture of the components is capable of flow but the reaction product is not and remains sticky after cross-linking. In another embodiment, the reaction product used in the present invention comprises a polyorganodimethylsiloxane.

In further accomplishing the foregoing objects, a process is provided, comprising the steps of (1) providing a fluid cross-linkable mixture of at least two reactive components, (2) pouring said mixture into a gap between the coating and the suspension mounting in the above-described insulator, and (3) permitting the components of the mixture to react and form a reaction product which is incapable of flow but remains sticky after cross-linking.

Further objects, features, and advantages of the present invention will become apparent from the following detailed description of preferred embodiments, when considered together with the attached drawings. It should be understood, however, that the subsequent detailed description of preferred embodiments and specific examples are presented by way of illustration only, since various changes and modifications within the spirit and scope of the invention will be apparent from the description to those skilled in the art.

BRIEF DESCRIPTION OF THE DRAWINGS

In the drawings:

FIG. 1 shows a cross section through the joint between the suspension mounting and the synthetic plastic rod of an insulator of the present invention;

FIG. 2 shows an enlarged cross section of a second claimed embodiment wherein an annular depression is provided in the suspension mounting.

DETAILED DESCRIPTION OF PREFERRED EMBODIMENTS

The monomers and polymers suitable for the present invention comprise two or more components which are reactive with respect to each other and each of which is of low viscosity. Consequently, they may be simply poured into the gap to be filled after mixing, whereby even the smallest cavities are filled in. It is advantageous if the intermixed components have prior to their chemical reaction a viscosity of less than about 100,000 mPa.s. The casting or filling process may be further facilitated by means of a vacuum. Optimum consistency is attained after cross-linking when the compound exhibits penetration values between about 1 and 500 mm/10 according to DIN 51 804 with a 150 g hollow cone. The compound hardened in the gap seals in an optimum manner and adheres to practically all solids as a result of its adhesiveness. Penetration values are determined by disposing the point of the test cone of a penetrometer so that it just touches the surface of a sample of the material being tested, and the arresting mechanism of the cone guide rod of the penetrometer is then released for a test period of five seconds so that the test cone can penetrate into the sample under the influence of its own weight, after which the depth of penetration is measured in tenths of a millimeter. Furthermore, there is no loss of adhesion to the walls of the gap due to the compound's expansion or contraction during changes in temperature. Also, drying out is no longer possible, in contrast to the case of synthetic greases such as silicone grease, where the diffusion of low molecular constituents into the adjacent synthetic plastic coatings can occur and cause drying.

The use of polymers based on the polyorganodimethylsiloxanes disclosed in U.S. Pat. No. 4,426,240 has been found to be especially advantageous, as these are resistant to weather and corrosion and are not attacked by ozone. Their resistance to humidity also reflects their water repellent character, and their high temperature resistance is provided by their molecular structure. Furthermore, the physical properties of these polymers do not vary much over a wide range of temperatures, so that their consistency within the operating range of high voltage compound insulators remains practically unaffected. The aforementioned consistency properties of the siloxanes can be achieved by providing that during cross-linking of the reaction partners, chain growth of the molecular chains primarily takes place. Control of this type of the cross-linking process is possible in the case of polydimethylsiloxanes by the use of catalysts, which corss-link advantageously at room temperature.

A further advantage is achieved by providing in the inner wall of the metallic mounting a circumferential, annular groove-like depression, which is filled with the corresponding sealer and serves as a reservoir during extreme temperature variations.

With reference now to the drawings, several schematically illustrated embodiments of the invention are shown. As seen in FIG. 1, the high voltage compound insulator of the present invention comprises a fiber reinforced synthetic plastic rod 1 for the transmission of mechanical forces, a surrounding coating 2, which may be further equipped with synthetic rubber shields 3, and corresponding suspension mountings 4 made of metal. The rod 1 itself comprises a glass fiber reinforced epoxy resin, the coating 2 and the shields 3 of silicone rubber, with the coating 2 being fastened to the glass fiber reinforced rod 1 by means of adhesive agents. The suspension mounting 4 is designed so that the coating 2 projects into the mounting. The latter is also provided with a circumferential bead 5, which has the function of destabilizing any partial arc that may occur, thereby preventing thermal overloading of the insulator rod. The gaps 6 remaining between the suspension mounting 4 and the coating are filled with a monomer or polymer, such as polyorganodimethylsiloxane, by supplying at least two reactive cross-linkable components in liquid form, with one of the components containing an organically based catalyst. The chain length and structure of the two siloxanes determine the penetration value.

For very narrow gaps in particular, an annular groove-like depression 7 in the suspension mounting 4, as shown in FIG. 2, is suitable as a reservoir for the polymers or monomers.

What is claimed is:

1. A high voltage insulator comprising:
(a) a synthetic plastic rod;
(b) an electrically insulating coating on at least a portion of said rod;
(c) a suspension mounting into which an end of said rod is inserted, said suspension mounting surrounding at least a portion of said coating at the location where said rod is inserted to form a gap between (i) said rod and coating and (ii) said suspension mounting, and
(d) a single, unitary seal in said gap completely filling the cavities between the rod and coating and the mounting, said seal comprising a cross-linked siloxane reaction product of two or more reactive components, said reaction product being incapable of flow and remaining sticky after cross-linking and having a penetration value after cross-linking of between about 1 and about 500 mm/10 with a 150 g hollow cone.

2. A high voltage insulator according to claim 1, wherein said reactive components comprise monomers or polymers.

3. A high voltage insulator according to claim 1, wherein said reaction product is a polyorganodimethylsiloxane.

4. A high voltage insulator according to claim 1, further comprising a circumferential, annular groove-like depression in the inner wall of said suspension mounting at said location where said rod is inserted, said depression defining an enlargement of said gap.

5. A high voltage insulator according to claim 4, wherein said depression comprises a reservoir for said reaction product.

6. A high voltage insulator according to claim 1, wherein said suspension mounting is further provided with a circumferential bead for destabilizing partial arcs.

7. A method for sealing a high voltage insulator comprising:
(a) a synthetic plastic rod;
(b) an electrically insulating coating on said rod; and
(c) a suspension mounting into which at least one end of said rod is inserted, said suspension mounting surrounding said coating at the location where said rod is inserted, said method comprising the steps of (1) providing a cross-linkable mixture of at least two reactive components which form a cross-linked siloxane upon reaction, (2) pouring said mixture into a gap between said coating and said suspension mounting filling the cavities of the gap between rod, coating and mounting, and (3) permitting the components of said mixture to react and form a single, unitary seal consisting of a siloxane reaction product which is incapable of flow and remains sticky after cross-linking.

8. A method for sealing a high voltage insulator according to claim 7, wherein said cross-linkable mixture of components has a viscosity prior to cross-linking of less than about 100,000 mPa.s.

9. A method for sealing a high voltage insulator according to claim 7, wherein said reaction product comprises a polyorganodimethylsiloxane.

* * * * *